US007150323B2

(12) United States Patent
Ford

(10) Patent No.: US 7,150,323 B2
(45) Date of Patent: Dec. 19, 2006

(54) SHOULDER RING SET ON CASING HANGER TRIP

(75) Inventor: David L. Ford, Katy, TX (US)

(73) Assignee: Vetco Gray Inc., Houston, TX (US)

( * ) Notice: Subject to any disclaimer, the term of this patent is extended or adjusted under 35 U.S.C. 154(b) by 9 days.

(21) Appl. No.: 11/189,387

(22) Filed: Jul. 26, 2005

(65) Prior Publication Data

US 2006/0016604 A1 Jan. 26, 2006

Related U.S. Application Data

(60) Provisional application No. 60/591,067, filed on Jul. 26, 2004.

(51) Int. Cl.
*E21B 29/12* (2006.01)

(52) U.S. Cl. ..... 166/348; 166/208; 166/212; 285/123.4

(58) Field of Classification Search ..... 166/341, 166/344, 345, 348–350, 367, 368, 208, 212; 285/123.2, 123.4
See application file for complete search history.

(56) References Cited

U.S. PATENT DOCUMENTS 3,603,401 A * 9/1971 Nelson et al. ..... 166/313
4,181,331 A * 1/1980 Cowan ..... 285/123.4
4,550,782 A * 11/1985 Lawson ..... 166/382
4,569,404 A * 2/1986 Milberger et al. ..... 166/208
4,641,708 A * 2/1987 Wightman ..... 166/208
4,691,780 A * 9/1987 Galle et al. ..... 166/348
4,697,828 A * 10/1987 Chou ..... 285/18
4,757,860 A * 7/1988 Reimert ..... 166/208
4,903,992 A * 2/1990 Jennings et al. ..... 285/24
4,911,244 A * 3/1990 Hynes ..... 166/368
5,060,724 A * 10/1991 Brammer et al. ..... 166/208
5,066,048 A * 11/1991 Farrell ..... 285/18
5,163,514 A * 11/1992 Jennings ..... 166/368
5,247,996 A * 9/1993 Milberger ..... 16/348
5,307,879 A * 5/1994 Kent ..... 166/382
6,302,211 B1 10/2001 Nelson et al.
6,598,673 B1 * 7/2003 Hosie et al. ..... 166/208
7,025,145 B1 * 4/2006 Emmerson ..... 166/348

* cited by examiner

*Primary Examiner*—Thomas A Beach
(74) *Attorney, Agent, or Firm*—Bracewell & Giuliani LLP

(57) ABSTRACT

A wellhead housing has a bore with a support shoulder, a ramp surface extending upward and outward from the support shoulder, and a recess extending upward from the ramp. A split, resilient load ring is carried in an initial position in the recess. A retractable and axially movable latch ring is carried in the recess above the load ring. A casing hanger has a profile that engages the latch ring as the casing hanger moves downwardly in the bore, causing the latch ring to move downward and pushing the load ring to the set position.

19 Claims, 4 Drawing Sheets

SHOULDER RING SET ON CASING HANGER TRIP

CROSS-REFERENCE TO RELATED APPLICATION

This application claimes priority to provisional application 60/591,067 filed Jul. 26, 2004.

FIELD OF THE INVENTION

This invention relates in general to subsea wellhead assemblies, and in particular to a full bore wellhead housing, wherein the operator sets a casing hanger load shoulder ring during the casing hanger running procedure.

BACKGROUND OF THE INVENTION

A typical subsea well has a wellhead housing at the upper end of the well. The wellhead housing is a tubular member having a bore. A string of large diameter casing attaches to the lower end of the wellhead housing and extends into the well. After further drilling through the wellhead housing, a smaller diameter string of casing is installed. A casing hanger at the upper end of the smaller diameter string of casing lands in the bore on a load shoulder.

In one type of wellhead housing, the load shoulder is permanently formed in the bore during manufacturing. This permanent load shoulder reduces the diameter of the bore below the load shoulder. In some instances, a full diameter is desired for the entire length of the bore. It has been proposed to install a split load ring in the bore before running the first casing hanger to provide a load shoulder. However, running the load ring on a running tool would require an extra trip from the drilling rig to the sea floor. In very deep water, the extra trip would be expensive.

In another technique, a split load ring is secured in a contracted diameter position to the casing hanger. When the casing hanger enters the bore, the load ring moves to a set position on a support shoulder provided in the bore.

SUMMARY OF THE INVENTION

In this invention, a support shoulder is located in the wellhead housing. The support shoulder has an inner diameter equal or greater than the full bore of the wellhead housing and is located at the lower end of a recess. A split, resilient load ring is carried in an expanded diameter initial position in the recess above the support shoulder. The load ring is movable downwardly in the recess to a set position in engagement with the support shoulder. When moving downward, the load ring contracts to a smaller diameter.

An actuator is carried in the bore above the load ring for moving the load ring from the initial position to the set position. The casing hanger is provided with a profile that engages the actuator while being lowered into the wellhead housing. Continued downward movement of the casing hanger causes the actuator to move the load ring to the set position. The casing hanger lands on the load ring as it moves to the set position.

DETAILED DESCRIPTION OF THE INVENTION

Figure 1:
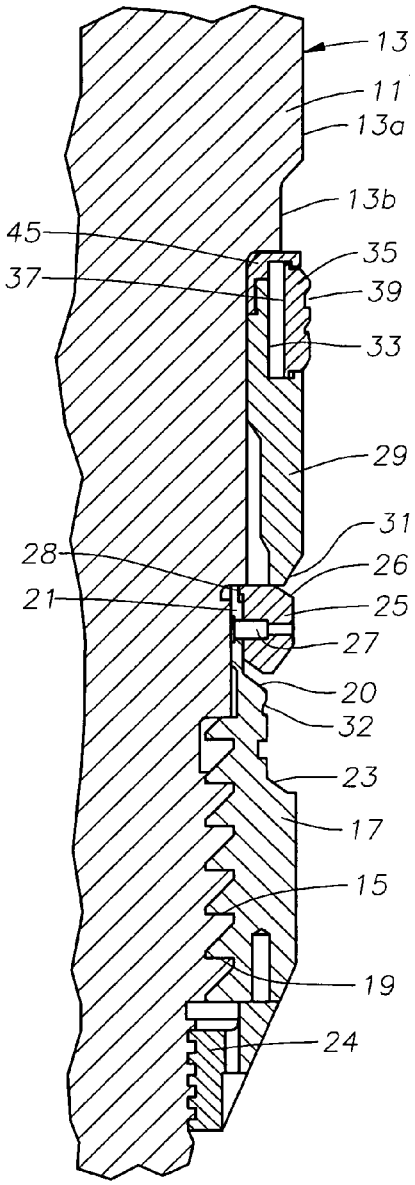
FIG. 1 is a vertical sectional view of a portion of a wellhead housing having a shoulder ring assembly located in a retracted position.

Referring to FIG. 1, wellhead housing 11 is a large tubular member that is typically located at the upper end of a well in a subsea location near the sea floor. Wellhead housing 11 has a bore 13 extending through it with an internally threaded profile 15. Bore 13 has a minimum inner diameter portion 13*a* and an enlarged diameter portion or recess 13*b* extending below.

A support ring 17 has external threads 19 that secure to threads 15 within wellhead housing bore portion 13*b*. Support ring 17 is a solid cylindrical member that is stationarily mounted to wellhead housing 11 prior to lowering wellhead housing 11 into the sea. Support ring 17 has an an upward facing support shoulder 23, a ramp 20 above support shoulder 23, and a neck 21 extending upward from ramp 20. Neck 21 has a larger inner diameter than the smallest inner diameter bore portion 13*a*. A retainer ring 24 secures to a threaded profile formed in bore portion 13*b* below support ring 17. Retainer ring 24 retains support ring 17 in engagement with threaded profile 15. Support shoulder 23 has an inner diameter that is equal or greater than the inner diameter of portion bore 13*a*.

Figure 2:
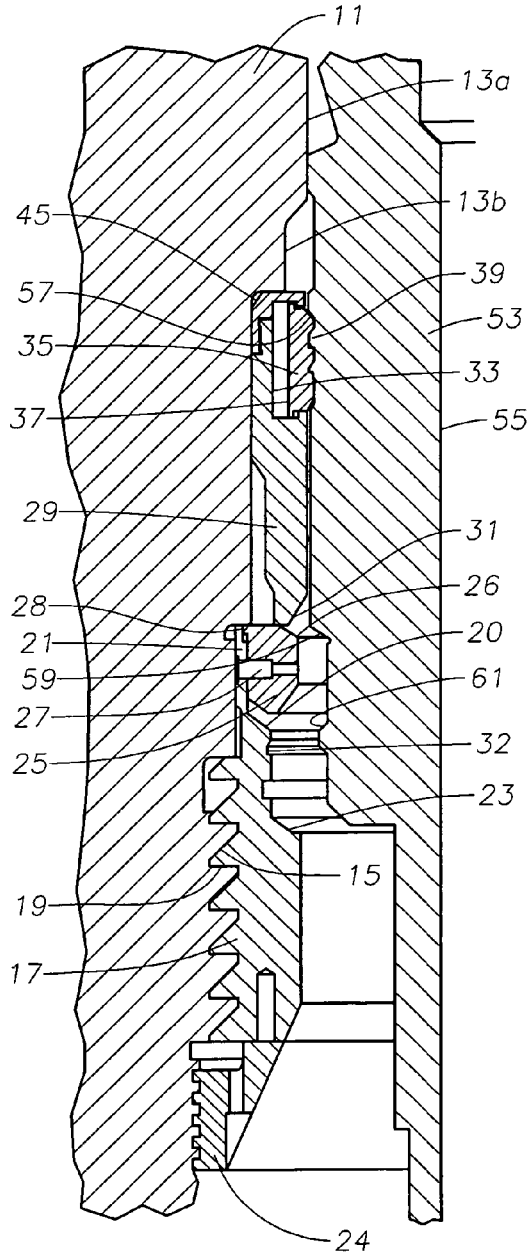
FIG. 2 is a sectional view of the portion of the wellhead housing of FIG. 1, and further showing a casing hanger in the process of engaging an actuator ring of the shoulder ring assembly.
Figure 4:
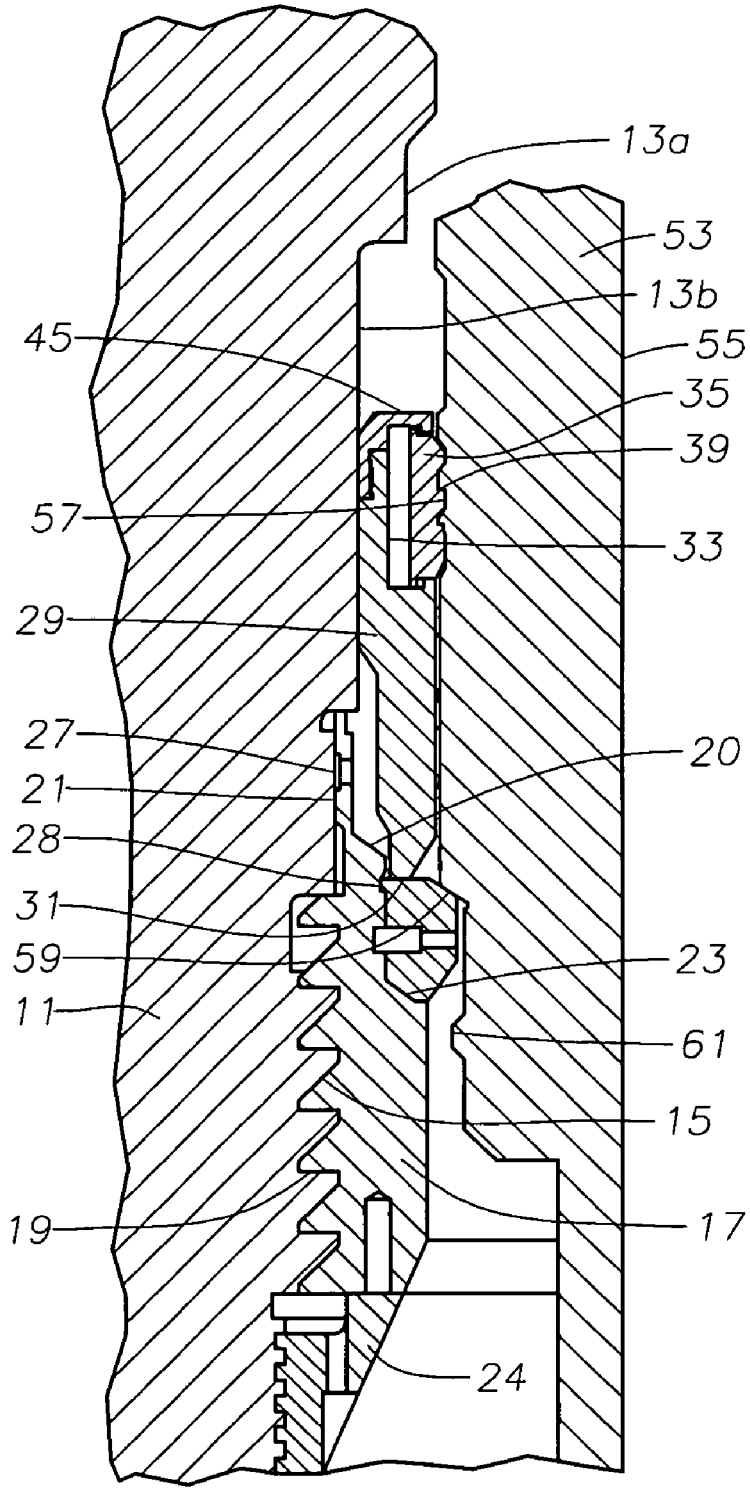
FIG. 4 is a sectional view of the portion of the wellhead housing of FIG. 1, showing the casing hanger and load shoulder ring in a fully landed position.

A split load ring 25 initially mounts to neck 21 by a shear pin 27. Shear pin 27 releasably retains load ring 25 in an initial diameter expanded position. Split load ring 25 is carried on the inner diameter of neck 21 initially in an upper position, as shown in FIGS. 1 and 2. Split load ring 25 is biased outward, and is movable from the upper position down ramp 20 to a set position on support shoulder 23, as shown in FIG. 4. In the lower position, load ring 25 is located farther inward than while in the upper retracted position. Split load ring 25 has an upward and inward facing engagement shoulder 26. The inner diameter of load ring 25 is equal or greater than the inner diameter of bore portion 13*a* while in the initial position, and less than bore portion 13*a* while in the set position.

Load ring 25 has a protruding band 28 on its outer diameter for snapping into engagement with a groove 32 formed on support ring 17 above support shoulder 23. Band 28 and groove 32 releasably fasten load ring 25 to support ring 17 when load ring 25 moves to its set position.

An actuator ring 29 is carried within recessed bore portion 13*b* for movement between an upper position shown in FIG. 1 and a lower position shown in FIG. 4. Actuator ring 29 is a rigid cylindrical member that has a lower end 31 in contact with an upper side of load ring 25. In the example shown, an outer diameter portion of actuator ring 29 at lower end 31 is spaced inward a selected distance from the sidewall of bore portion 13*b*. Actuator ring 29 and load ring 25 are also mounted in bore portion 13*b* prior to lowering wellhead housing 11 into the sea. Actuator ring 29 has an annular recess 33 formed within its inner diameter.

A latch ring 35 is movably carried within recess 33. Latch ring 35 is a split ring that is inward biased. Latch ring 35 has an outer diameter 37 that is spaced radially inward from the cylindrical base of recess 33. Latch ring 35 has a profile 39 formed on its inner diameter that comprises a selected pattern of grooves and lands. In the initial position, profile 39 protrudes inward a short distance past the inner diameter of actuator ring 29. Also, the inner diameter of profile 39 is slightly less than the inner diameter of bore portion 13*a*.

Figure 5:
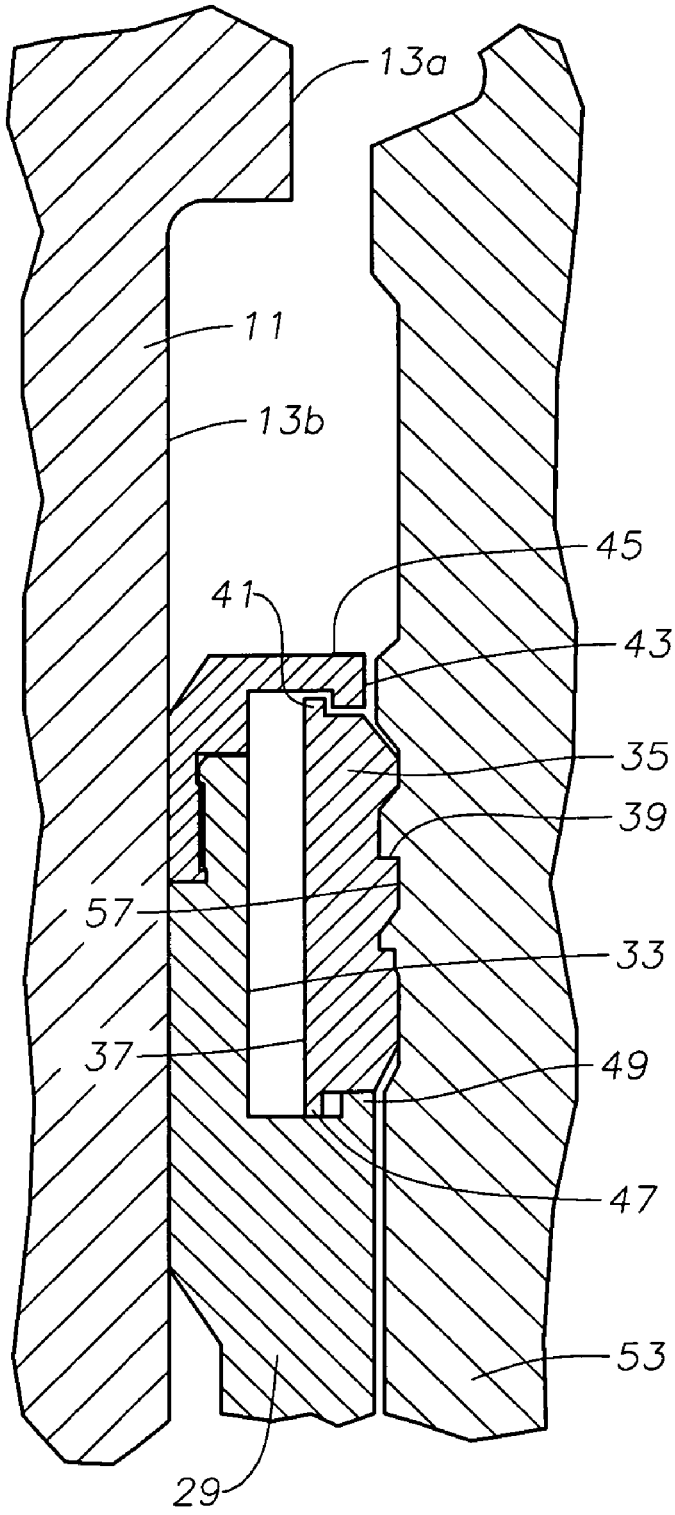
FIG. 5 is an enlarged sectional view of part of the actuator assembly after the casing hanger has fully landed.

Referring to FIG. 5, latch ring 35 has an upward protruding rim 41 located on its inner diameter 37. Upper rim 41 locates on the outer side of a downward protruding lip 43 of a retainer cap 45. Latch ring 35 has a downward protruding lower rim 47 on its lower end at its outer diameter 37. Lower rim 47 locates radially outward from an upward protruding lower lip 49, which is formed in recess 33. Lips 43 and 49 and rims 41 and 47 retain latch ring 35 within recess 33, but allow radial movement. Lower rim 47 is sufficiently thin so as to buckle or crush under the weight of casing, as will be subsequently explained. Retainer cap 45 is secured to an upper portion of actuator ring 29, such as by threads.

When the operator wishes to run casing, the operator secures a casing hanger 53, shown in FIG. 2, to the casing and lowers it through a riser (not shown) and into the well. Casing hanger 53 has a bore 55 and an external profile 57. Profile 57 comprises a plurality of grooves and lands that match profile 39 of latch ring 35. Because of the protrusion of latch ring 35, when profile 57 aligns with profile 39, latch ring 35 will snap into engagement with casing hanger 53, as shown in FIG. 1. Casing hanger 53 has a downward facing shoulder 59 that is at an angle for mating with engagement shoulder 26 on the upper surface of load ring 25. When load ring 25 lands on support shoulder 23, as shown in FIG. 4, casing hanger shoulder 59 will be in mating abutment with engagement shoulder 26 of load ring 25. Band 28 on load ring 25 will snap into engagement with groove 32, preventing upward movement of load ring 25.

Casing hanger 53 may have a protruding rib or band 61 formed on its outer diameter below load shoulder 59 for providing a feedback to determine that band 28 on load ring 25 has latched into the groove 32 of support ring 17. After load ring 25 has locked into groove 32, the operator can lift casing hanger 53 a short distance to test whether the engagement was properly made. While lifting, rib 61 will contact load ring 25 and exert an upward force. The operator can exert an overpull above the weight of the casing string to an amount less than what would be required to completely pull load ring 25 from support shoulder 23.

Figure 3:
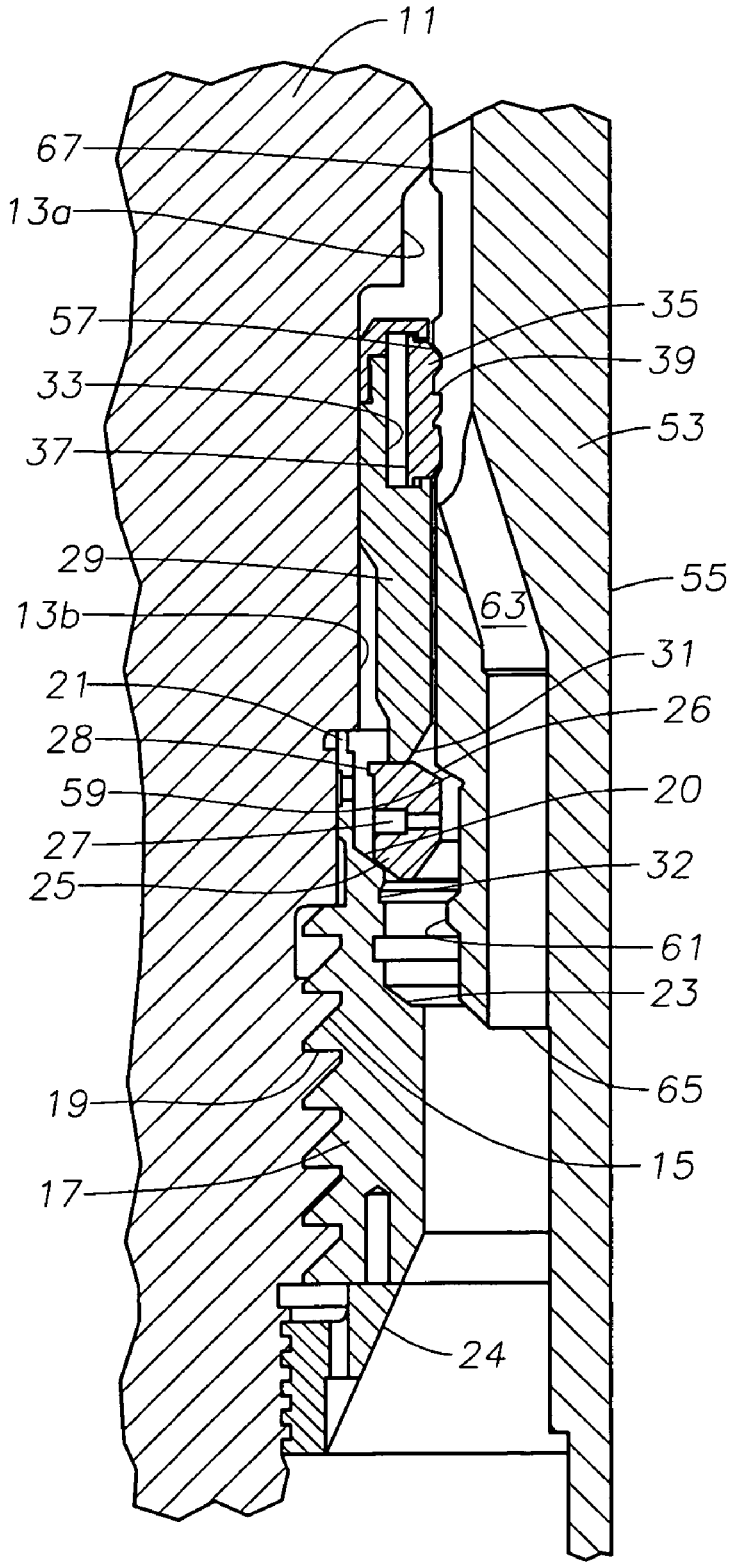
FIG. 3 is a sectional view of the portion of the wellhead housing of FIG. 1, showing the casing hanger moving the actuator ring and the load shoulder ring downward.

Casing hanger 53 has a plurality of flow passages 63 (only one shown) that are illustrated in FIG. 3, but for clarity, are not shown in the other views. Flow passages 63 extend from a lower shoulder 65 upward to the vicinity of profile 57. Each flow passage 63 joins a channel 67 that extends along the outer diameter of casing 53. Flow passages 63 and channels 67 serve for returning flow during cementing.

In operation, the components shown in FIG. 1 will be assembled at the factory, at a field site or on a drilling rig, prior to lowering wellhead housing 11 into the sea. Preferably, the operator installs a wear bushing or protective sleeve over support ring 17 and actuator ring 29. Wellhead housing 11 is installed in a conventional manner, typically within an outer wellhead (not shown) that is secured to conductor pipe extending into an upper portion of the well. Wellhead housing 11 will be secured to a string of large diameter casing and lowered into the well to a selected depth. The operator connects wellhead housing 11 to a drilling riser and blowout preventer and continues drilling through wellhead housing 11 to the desired depth.

After the drilling has been completed, the operator removes the wear bushing, preferably on the last trip of the drill bit. The operator then lowers a string of casing on casing hanger 53. As casing hanger 53 aligns with actuator ring 29, its profile 57 will engage profile 39 of latch ring 35.

Continued downward movement causes shear pin 27 to shear as shown in FIG. 3. Load ring 25 slides down ramp 20 and inward to the set position of FIG. 4, where it latches into place on support shoulder 23. Casing hanger shoulder 59 will abut load ring 25. Lower rim 47 (FIG. 5) will crush or buckle under the weight imposed by casing hanger 53. This deformation causes the weight of the string of casing to bypass latch ring 35 and actuator ring 29 and pass directly from casing hanger 53 through shoulder 59, load ring 25, support ring 17 and into wellhead housing 11. The operator cements the casing in a conventional manner.

The invention has significant advantages. While in the initial position, the load ring provides full bore access during initial drilling operations. When needed, the load ring is moved to the set position, providing a load shoulder smaller than the diameter of the bore of the housing above the load ring. The movement to the set position occurs automatically when the casing hanger is being installed. An additional trip to move the load ring to the set position is not required.

While the invention has been shown in only one of its forms, it should be apparent to those skilled in the art that it is not so limited but is susceptible to various changes without departing form the scope of the invention.

The invention claimed is:

1. A wellhead assembly, comprising:

a wellhead housing having a bore containing a support shoulder;

a split, resilient load ring carried in an expanded initial position in the bore above the support shoulder, the load ring being movable downwardly to a contracted set position in engagement with the support shoulder;

an actuator carried in the bore above the load ring for moving the load ring from the initial position to the set position;

a casing hanger for securing to a string of casing and lowering into the wellhead housing; and a profile on the casing hanger that engages the actuator as the casing hanger moves downwardly in the bore, causing the load ring to move to the set position and the casing hanger to land on the load ring.

2. The wellhead assembly according to claim 1, wherein the actuator comprises:

a rigid actuator ring; and a retractable latch ring carried by the actuator ring, the latch ring having a profile that is engaged by the profile on the casing hanger.

3. The wellhead assembly according to claim 1, wherein the actuator and the load ring are carried within a recess in the bore.

4. The wellhead assembly according to claim 1, wherein the support shoulder has an inner diameter that is at least equal to a minimum inner diameter of the bore above the support shoulder.

5. The wellhead assembly according to claim 1, wherein the load ring has an inner diameter while in the initial position that is at least equal to a minimum inner diameter of the bore above the load ring, and an inner diameter while in the set position that is smaller than the minimum inner diameter of the bore above the load ring.

6. The wellhead assembly according to claim 1, further comprising:

a tapered surface in the bore extending upward and outward from the support shoulder for causing the load ring to retract while moving to the set position.

7. The wellhead assembly according to claim 1, further comprising:

a retainer member on the load ring that snaps into a receptacle in the bore when the load ring moves into the set position.

8. A wellhead assembly, comprising:

a wellhead housing having a bore with an axis and containing a support shoulder, a ramp surface extending upward and outward from the support shoulder, and a recess extending upward from the ramp;

a split, resilient load ring carried in an initial position in the recess, the load ring being movable downwardly on the ramp surface to a set position on the support shoulder, the load ring having an engagement shoulder on an upper side;

a retractable and axially movable latch ring carried above the engagement shoulder of the load ring, the latch ring having an initial retracted position that has an inner diameter smaller than a minimum inner diameter of the bore above the latch ring;

a casing hanger for securing to a string of casing and lowering into the wellhead housing; and a profile on the casing hanger that engages the latch ring as the casing hanger moves downwardly in the bore, causing the latch ring to move downward and pushing the load ring to the set position, whereupon the casing hanger lands on the engagement shoulder of the load ring.

9. The wellhead assembly according to claim 8, wherein the load ring has an inner diameter while in the initial position that is greater than the inner diameter of the latch ring while in the retracted position.

10. The wellhead assembly according to claim 8, wherein the inner diameter of the latch ring while in the retracted position is smaller than an inner diameter of the load ring while in the initial position and smaller than an inner diameter of the support shoulder.

11. The wellhead assembly according to claim 8, further comprising:

a rigid actuator ring carried in the recess for axial movement, the actuator ring having an inner diameter containing an annular recess; and wherein the latch ring is carried in the recess of the actuator ring.

12. The wellhead assembly according to claim 8, further comprising:

a retainer member on the load ring that snaps into a receptacle in the bore when the load ring moves into the set position.

13. The wellhead assembly according to claim 12, further comprising a protrusion on the casing hanger that is positioned below the load ring when the load ring is in the set position, such that an upward pull on the casing hanger causes the protrusion to exert an upward force on the load ring, the upward force being resisted by the retainer member.

14. The wellhead assembly according to claim 8, further comprising:

a retainer that releasably retains the load ring in the initial position, the retainer releasing the load ring after the casing hanger engages the latch ring and sufficient weight is applied.

15. A method for installing a casing hanger in a subsea wellhead housing having a bore, comprising:

(a) providing a support shoulder in the bore of the wellhead housing;

(b) mounting a split, resilient load ring in an expanded initial position in the bore above the support shoulder;

(c) mounting an actuator in the bore above the load ring; then (d) lowering the wellhead housing into the sea and installing the wellhead housing at the upper end of a well; then (e) securing a string of casing to a casing hanger and lowering the casing hanger into the wellhead housing; and (f) engaging the casing hanger with the actuator and pushing the actuator and the load ring downward, causing the load ring to contract and land on the support shoulder and the casing hanger to land on the load ring.

16. The method according to claim 15, wherein:

step (c) comprises providing the actuator with a retractable latch ring having a profile on its inner diameter; and step (f) comprises providing the casing hanger with a profile that mates with the profile on the latch ring.

17. The method according to claim 15, wherein:

step (b) further comprises releasbly retaining the load ring in the initial position; and step (f) comprises applying sufficient weight on the casing hanger to release the load ring from the initial position.

18. The method according to claim 15, wherein step (f) further comprises fastening the load ring onto the support shoulder in response to the downward movement of the load ring.

19. The method according to claim 18, further comprising after fastening the load ring onto the support shoulder, applying an upward force to the load ring by pulling upward on the casing hanger to test whether the load ring is fastened to the support shoulder.

* * * * *